US005214871A

United States Patent [19]

DiCataldo, Sr.

[11] Patent Number: 5,214,871

[45] Date of Patent: Jun. 1, 1993

[54] GOLF BAG TAG

[76] Inventor: Charles M. DiCataldo, Sr., 23 Grafton Dr., Morris Plains, N.J. 07950

[21] Appl. No.: 640,044

[22] Filed: Jan. 11, 1991

[51] Int. Cl.[5] ..... G09F 3/20

[52] U.S. Cl. ..... 40/649; 40/6

[58] Field of Search ..... 40/6, 649, 661, 642, 40/611, 634, 645, 5, 316, 318, 330, 152

[56] References Cited

U.S. PATENT DOCUMENTS

| | | | |
|---|---|---|---|
| 2,288,570 | 6/1942 | Mungen | 40/611 |
| 3,596,391 | 8/1971 | Knight, Jr. | 40/152 |
| 3,703,045 | 11/1972 | Nyman | 40/152 |
| 4,524,867 | 6/1985 | Klein et al. | 40/661 X |
| 4,679,341 | 7/1987 | Goldman | 40/611 |
| 4,682,430 | 7/1987 | Ramsay | 40/5 |
| 4,835,889 | 6/1989 | McClymonds | 40/611 |

FOREIGN PATENT DOCUMENTS

| | | | |
|---|---|---|---|
| 134025 | 7/1933 | Austria | 40/642 |
| 2096377 | 10/1982 | United Kingdom | 40/5 |
| WO89/10605 | 11/1989 | World Int. Prop. O. | 40/642 |

*Primary Examiner*—Kenneth J. Dorner
*Assistant Examiner*—J. Bonifanti
*Attorney, Agent, or Firm*—Thomas L. Adams

[57] ABSTRACT

A tag apparatus for attachment to a bag, such as a golf bag, which includes a first flat generally rectangular-shaped body formed of a rigid plastic material and having, on both its front side and back side, a contiguous raised ridge along its perimeter; a plurality of horizontally disposed raised ridges positioned in an approximately parallel fashion with respect to one another in a spaced sequential fashion and extending from one longitudinal edge to the other longitudinal edge; and an aperture surrounded by a continuous raised ridge. This first flat body is removably insertable into a U-shaped envelope formed by the front and back panels of a second flat transparent body. The front and back panels are joined at one common end edge and are not connected along their longitudinal edges nor at their other end edges. During the insertion of the first flat body, the front and back panels are forced apart and their tendency to return to the more relaxed configuration resiliently retains the first flat body within the U-shaped envelope. The front and back panels each have an aperture positioned such that when the first body is resiliently retained in the U-shaped envelope, the apertures of the front and back panels register with the aperture of the first flat body to allow an elongated strap or cord to be passed through the first flat body and the second flat transparent body.

23 Claims, 2 Drawing Sheets

GOLF BAG TAG

TECHNICAL FIELD

This invention relates generally to sports equipment and more particularly to golfing accessories.

BACKGROUND OF THE INVENTION

The present invention relates to a tag apparatus for attachment to a bag, and more particularly to a tag apparatus for attachment to a golf bag.

Prior to the instant invention, there have been efforts made to attach accessories to golf bags. Most of these accessories have taken the form of accessory holders to golf bags or on the body of the person. Examples of this type of accessory holders are illustrated in Pommenville, U.S. Pat. No. 4,830,248; Schwein, U.S. Pat. No. 4,746,045; Kline, U.S. Pat. No. 4,699,303; Darnell, U.S. Pat. No. 4,361,934; Blastic, U.S. Pat. No. 4,157,152; Kline, U.S. Pat. No. 4,449,310. The devices as illustrated in the aforesaid patents, which represent the best prior art known to applicant relative to the subject invention, fails to provide an apparatus which provides a function that is practical for the purpose intended for the present invention.

U.S. Pat No. 4,830,248 describes a device which is attachable to a golf bag and which holds golf accessory articles, such as a score card, pencil, golf tees and the like in a secure but removable position for convenient access to the user.

U.S. Pat. No. 4,746,045 discloses a golf score card and pencil holder formed of rigid transparent plastic and of generally rectangular-shaped configuration for use by a golfer. A transparent envelope is clamped against the clamping surface of the golf score card holder. The score card is positioned between the panels of the envelope for ready examination by a user. The envelope and score card are readily removed from the holder by a user for entry of the golfer's score.

U.S. Pat. No. 4,699,303 discusses a golf article retaining device adapted to be removably attached to a supporting surface. This golf article retaining device retains a variety of different sized golf score cards and a receptacle for receiving and retaining a marking implement which is useful in releasably holding golf score cards, golf marking pencils and golf tees. The device is adapted to be easily and positively mounted to a supporting surface on a golf bag or on a golfer's belt in position so that easy access is obtainable to the golf score card, marking device and tees being releasably held on the device.

U.S. Pat. No. 4,361,934 describes a golf score card and pencil holder which includes a main body portion in the form of a tag provided with a loop and an elongated cord laced through holes provided in the main body portion.

U.S. Pat. No. 4,157,152 describes a golf score card and pencil holder upon which a score card and a writing implement are conveniently supported so a player can easily keep track of his score, and the holder being readily attachable to a top of a golf bag that one carries.

U.S. Pat. No. 4,449,310 describes a golf clip including a member of spring-like material which is adapted to be resiliently removably mounted in a support structure. The member is designed to resiliently and removably hold a golf score card and has a receptacle for receiving and removably retaining a scoring implement.

None of the above-discussed references discloses a tag apparatus for attachment to a bag which comprises a first flat rectangular-shaped body formed of a rigid plastic material which has a series or plurality of horizontally disposed raised ridges extending from one longitudinal edge to another and positioned in an approximately parallel fashion with respect to one another in a spaced sequential fashion from one edge toward the other end edge, wherein the ridges define a series of generally rectangular-shaped spaces in which adhesive labels containing readable printed instructions can be secured within each generally rectangular-shaped space.

These references also do not teach inserting such a label-containing flat rectangular-shaped body composed of a rigid plastic material into an envelope defined by a second transparent generally flat rectangular-shaped body comprising front and back panels which are integrally joined at one end and are not connected at the opposite end nor along their longitudinal edges, and wherein the panels of the second flat transparent body are displaced during the insertion of the first flat body such that tendency of the panels to return to the more relaxed configuration, together with the assistance of contraction lips present on a T-shaped head positioned at one end of the first flat body which grip the open ends of the front and back transparent panels, resiliently retains the first flat body.

Furthermore, these references also do not teach the insertion of such a label-containing first flat rectangular-shaped body into an envelope defined by a second transparent generally flat rectangular-shaped body wherein the front and back panels are in a frictional and watertight and/or airtight contact with the ridges of the first flat body and through which the labels adhesively secured in the first flat body are readable.

As will be described in more detail hereinafter, applicant has developed such a unique tag apparatus which is attachable to a bag.

The tag apparatus of the present invention contains, on both sides of the tag, a series of readable printed instructions intended to provide a novice player of a game, such as golf, with basic instructions during the course of the game. These instructions relate to the basic fundamentals of swing technique, including stance and grip of the golf club, head position, and follow-through. These instructions may take the form of pre-printed directions or handwritten personal reminders on adhesive labels located on the tag apparatus itself, and are easily readable by an examination of the tag. Where handwritten instructions are used, these individually-tailored instructions may be personal notes written by the golf player himself as reminders of basic fundamentals of swing technique, as well as reminders of any general flaws or personal weaknesses present in the player's game, so that he might avoid or correct them. These pre-printed instructions or handwritten personal reminders may relate to the full game or the short game, i.e., the portion of the golf game when the golf ball is on the green such as for the putt shot, chip shot, and golf pitch shot. A sand shot is also included in the short game. Accordingly, if the player discovers that his game is off or he is putting poorly, he may consult the instructions contained on the tag and correct what he is doing wrong.

Such individually tailored reminders need not be permanently affixed to the tag, but can be changed or replaced according to the present needs or demands of the player. If it is desired, for the sake of convenience, the front side of the tag apparatus may contain instructions relating to the full game, i.e., where a full swing is used, and the back side of the tag may contain instructions relating to the short game, i.e., where less than a full swing is used. Furthermore, a combination of generic pre-printed instructions and individually tailored handwritten instructions may be used.

The instructions are positioned in a lateral, sequential fashion on both sides of the tag and are protected from the damaging contacts with the elements of the outside environment such as air, water, dust, and wind by a covering of transparent plastic on both sides of the tag.

SUMMARY OF THE INVENTION

It is an object of the present invention to provide a novel tag apparatus which may be readily attachable to a bag, such as a golf bag, and which effectively retains a series of readable printed or handwritten instructions, positioned on both sides of the tag, to assist the golf player in his conduct of the game.

Another object of the present invention is to provide a transparent U-shaped envelope to hold and protect a flat rectangular-shaped, rigid body which itself contains a series of readable printed or handwritten instructions. The envelope is formed of a transparent rigid plastic material. The transparent surface also provides a hard surface which can be used for writing notes or jotting down various information about the golf course or anything else that the player desires.

Another object of this invention is to provide a novel tag apparatus for attachment to a bag wherein the two transparent panels which form the U-shaped envelope are resiliently displaceable from each other such that when the flat rectangular-shaped rigid body is inserted into the U-shaped envelope, the front and back panels are forced apart and their tendency to return to the more relaxed configuration, with the assistance of contraction lips present on a T-shaped head situated on one end of the flat rectangular-shaped rigid body and which grip the open ends of the front and back panels, resiliently and removably retains the flat rectangular-shaped rigid body within the envelope, thereby ensuring that the front and back panels are in frictional contact with the ridges of the flat rectangular-shaped rigid body which extend along the perimeter and across the longitudinal sides of the flat body. The resilient retention by the front and back transparent panels against the ridges of the first flat body is also intended to serve as a seal preventing the inflow of outside air, water or dust in the rectangular-shaped recesses defined by the ridges of the flat rectangular-shaped rigid body.

These and other objects and advantages of the present invention will no doubt become apparent upon a reading of the following descriptions and a study of the several figures of the drawing.

BRIEF DESCRIPTION OF THE DRAWINGS

In the drawings which illustrate the best mode presently contemplated for carrying out the present invention.

DETAILED DESCRIPTION OF THE PREFERRED EMBODIMENT OF THE INVENTION

Figure 1:
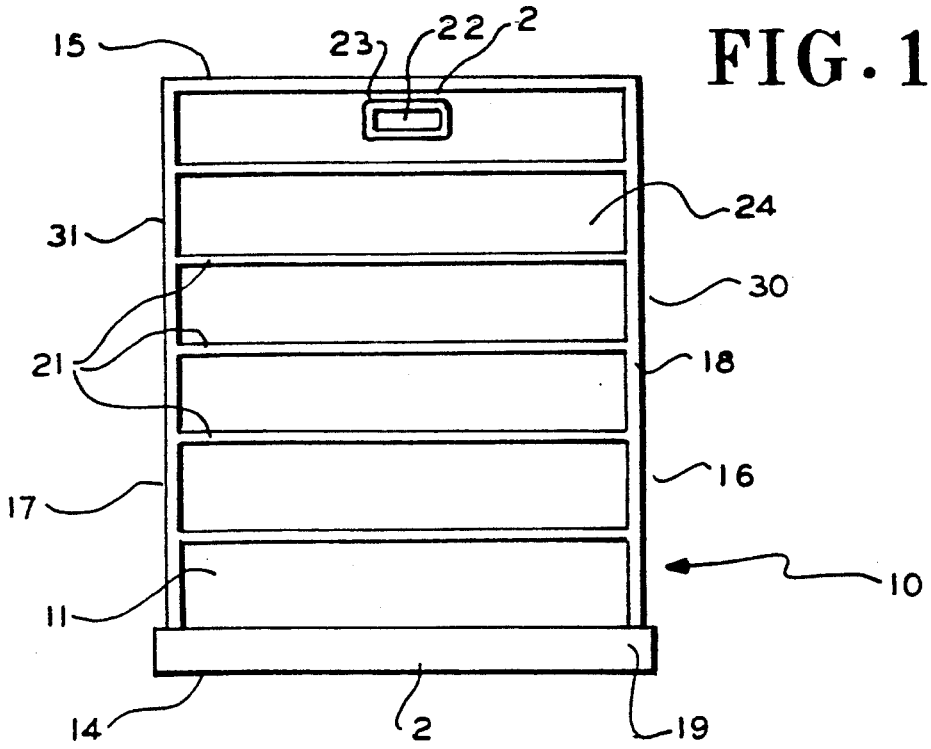
FIG. 1 is a front view of the tag apparatus of the present invention.
Figure 2:
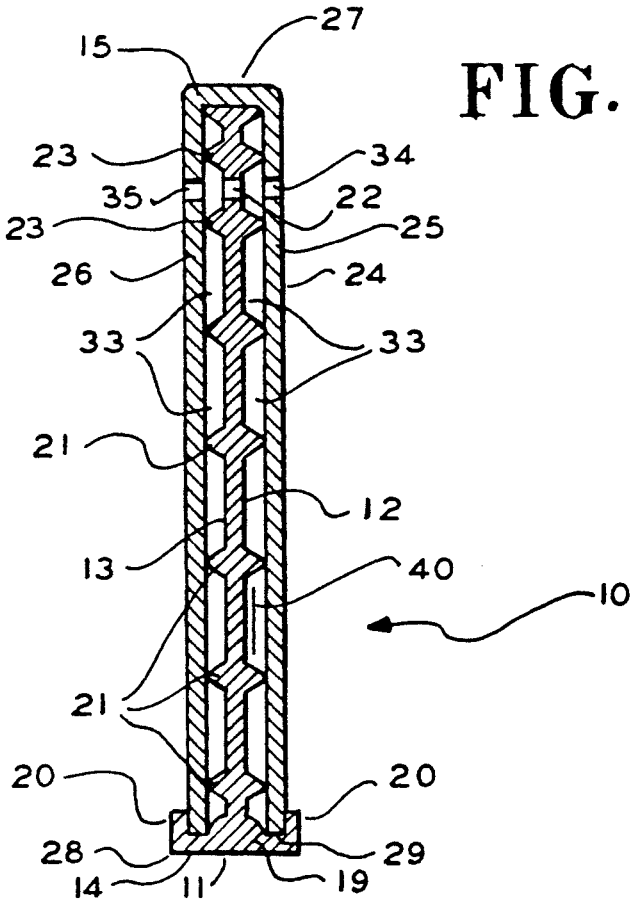
FIG. 2 is a cross-sectional view view of the tag apparatus of the present invention.
Figure 3:
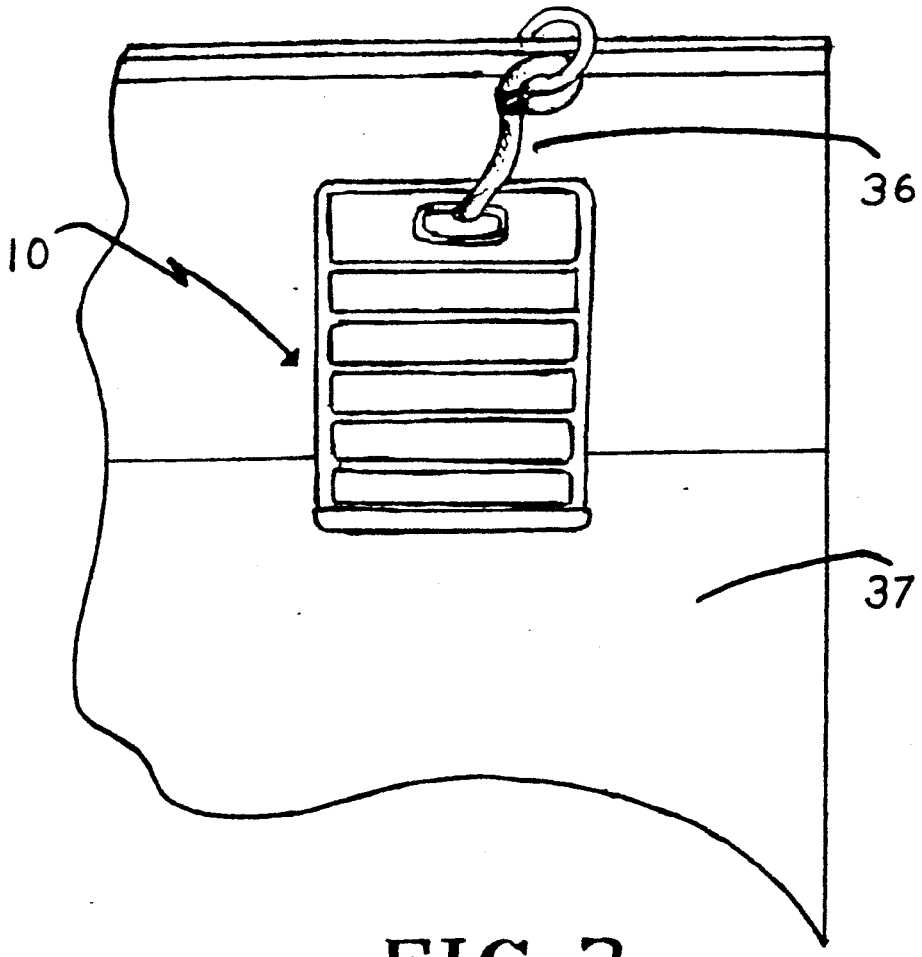
FIG. 3 is a fragmentary elevational front view of the tag apparatus of the present invention mounted on the end of a bag, such as a golf bag.

Referring now to the drawing and particularly to FIGS. 1 and 2, the tag apparatus as embodied in the subject invention is illustrated and is generally indicated at 10.

The tag apparatus of the present invention includes a first body 11 which is of generally rectangular configuration and is formed of a generally rigid plastic material. The first body 11 includes a substantially flat front side 12 and a substantially flat back side 13. The body includes first end edge 14 and second end edge 15 and has a longitudinal edge 16 which is disposed in a substantially parallel relation with the longitudinal edge 17.

The first body 11 further has a continuous raised ridge 18 along its perimeter on both its front side 12 and its back side 13 and which extends along longitudinal edge 16, first end edge 14, and longitudinal edge 17. The continuous raised ridge 18 is contiguous with front side 12 and back side 13.

The first body 11 also has a T-shaped head 19 disposed along its first end edge 14. The T-shaped head has a contraction lip 20 positioned along front side 12 and back side 13.

The first body 11 also includes a series of horizontally disposed raised ridges 21 which extend laterally from longitudinal edge 16 to longitudinal edge 17. The raised ridges 21 are disposed on both the front side 12 and the back side 13 in an essentially parallel manner with respect to each other in a generally spaced sequential fashion beginning from second end edge 15 and continuing to first end edge 14.

The number of these horizontally disposed raised ridges is preferably between 3 and 7. Most preferably, the number of the horizontally disposed raised ridges is 5.

First body 11 also includes an aperture 22 near second end edge 15. This aperture 22 is disposed approximately equi-distant from longitudinal edge 16 and longitudinal edge 17. The aperture 22 is surrounded by a continuous raised ridge 23 on both the front side 12 and the back side 13 of the first body 11.

The tag apparatus of the present invention also includes a transparent second body which is of a generally flat rectangular-shaped configuration. The transparent second body 24 includes a front panel 25 and a back panel 26, closed end 27 and open end edges 28 and 29, and longitudinal edge 30 and longitudinal edge 31. The front panel 25 and back panel 26 of the transparent body 24 are integrally joined at the closed end 27 of the transparent second body 24. The transparent body 24 therefore has a closed edge 27.

The front panel 25 and the back panel 26 are not connected along the longitudinal edge 30 or the longitudinal edge 31 and are further not connected along open end edge 28 and 29. The transparent second body therefore has an open end defined by open end edges 28 and 29 of the front panel 25 and the back panel 26.

The front panel 25 and the back panel 26 of the transparent second body 24 thus form a U-shaped envelope which has width dimensions only slightly more than the width dimensions of the first body 11. The front panel 25 and the back panel 26 are also resiliently displaceable from one another. This permits the first body 11 to be inserted into the second body 24 (U-shaped envelope). Therefore, when the first body 11 is inserted into the second body 24 (U-shaped envelope) through the open end at the end edges 28 and 29 of the front panel 25 and the back panel 26, the front panel 25 and the back panel 26 are forced apart and the tendency of the front panel 25 and the back panel 26 to return to their more relaxed configuration resiliently retains the first body 11 within the second body 24 (U-shaped envelope). In addition, the contraction lips 20 of the T-shaped head 19 of the first body 11 grip the front panel 25 and the back panel 26 along the end edges 28 and 29 of the front and back panels 25 and 26 in the manner depicted in FIG. 2.

Furthermore, the ridges 18, 21, and 23 disposed on the front side 12 and the back side 13 of the first body 11 are in frictional contact with the interior surfaces of the front panel 25 and the back panel 26 of the transparent second body 24. The first body 11 is thereby positioned in a firm relation with the interior surfaces of the front and back panels 25 and 26. The first body 11 is thus resiliently and removably retained in position in the second body 24 (U-shaped envelope).

The ridges also act to prevent contact of the front panel 25 and the back panel 26 with the surface of the front side 12 and the back side 13 of the first body 11. When the body 11 is inserted into the transparent second body 24 and is then resiliently retained by the front and back panels 25 and 26, the ridges 18, 21, and 23 of the first body 11 serve as an airtight and/or watertight seal preventing the inflow of outside air, dust, or water into the generally rectangular-shaped recesses or spaces 33, which are present, as defined by the ridges of the first body 11, between the front panel 25 and the back panel 26 of the transparent second body 24 and the front side 12 and back side 13 of the first body 11.

The front panel 25 also has an aperture 34 near closed end 27 and positioned approximately equi-distant from the longitudinal edges 30 and 31 of the back panel 25. The back panel 26 also has an aperture 35 near closed end 27 and positioned approximately equi-distant from the longitudinal edges 30 and 31 of the back panel 26. The apertures 34 and 35 are positioned such that when the first body 11 is resiliently retained in the transparent second body as previously described, the apertures 34 and 35 of the front and back panels 25 and 26 register with the aperture 22 of the first body 11 so as to allow an elongated strap or cord 36 to be passed through the transparent second body 24 and through the first body 11. The elongated strap or cord 36 may be used to removably attach the tag apparatus to a bag 39, such as a golf bag.

In use, labels or stickers, (such as label 40) containing readable marking of indicia or printed instructions which relate to the basic fundamentals regarding swing technique to be followed at various stages of the game and in different situations which arise during a game of golf, are adhesively secured within each generally rectangular-shaped spaces 33 defined by the horizontally disposed raised ridges 21 on the first body 11 and by the raised ridge 18 along the perimeter of the first body 11.

The tag apparatus of the present invention is preferably used in conjunction with, i.e., attached to, a golf bag where it is readily and conveniently available for consultation by the golf player.

While there are shown and described herein certain specific structures and features embodying the present invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A tag apparatus for attachment to a bag, comprising a first body and a second body, said first body and said second body being of a generally flat rectangular-shaped configuration, said first body including:

(a) a front side and a back side, (b) first and second longitudinal edges, and (c) a first end edge and a second end edge, said first body further having a T-shaped head positioned along said first end edge, said T-shaped head having a contraction lip disposed along each of said front side and said back side of said first body, said second body including:

(a) front and back panels being transparent, (b) first and second longitudinal edges, (c) a closed end, and (d) first and second open end edges, said front and said back panels being joined at at least one common edge, said common edge being said closed end, said front and said back panels not being connected along said first and said second longitudinal edge nor at said open end edges, said second body forming a U-shaped envelope with said front and back panels being resiliently displaceable to permit insertion of said first body into said second body, said second body applying to said first body a compressive border force spaced from said common edge, when said first body is inserted into said second body.

2. The tag apparatus according to claim 1 wherein said first body further has an aperture.

3. The tag apparatus according to claim 2, wherein said front and said back panels of said second body each have an aperture, said apertures of said front and said back panels being positioned such that when said first body is resiliently retained in said second body, said apertures of said front and said back panels register with said aperture of said first body.

4. The tag apparatus according to claim 1, wherein said first body is formed of a rigid plastic material.

5. The tag apparatus according to claim 1 wherein both of said front and said back panels are transparent.

6. The tag apparatus according to claim 1 wherein said first body has a continuous raised ridge, contiguous with said front and said back sides, along said first body's perimeter on both said front and said back sides of said first body and extending along said first and said second longitudinal edges and along said first end edge, said second body further having a plurality of horizontally disposed raised ridges extending from said first longitudinal edge to said second longitudinal edge on both said front and said back sides of said first body, and wherein said aperture of said first body is surrounded by a continuous raised ridge on both said front side and said back side of said first body.

7. The tag apparatus according to claim 6 wherein said plurality of horizontally disposed raised ridges are positioned in an approximately parallel fashion with respect to one another in a spaced sequential fashion beginning from said second end edge and continuing toward said first end edge, and wherein said continuous raised ridge and said horizontally disposed raised ridges define generally rectangular-shaped spaces.

8. The tag apparatus according to claim 7, wherein said contraction lips of said T-shaped head of said first body grip said front and back panels along their first end edges, said first body thereby being positioned in a firm relation with the interior surfaces of said front and said back panels, said ridges on said front and said back sides of said first body being in frictional contact with said front and said back panels of said second body, said first body thereby being resiliently and removeably retained within said second body.

9. The tag apparatus according to claim 8, wherein during said resilient retention of said first body within said second body, said ridges act to prevent contact of said front and said back panels with said front and back sides of said first body.

10. The tag apparatus according to claim 9, wherein said resilient retention by said front and said back panels of said second body against said ridges of said first body serves as an airtight seal preventing the inflow of outside air or dust into the spaces, defined by said ridges of said first body, between said front and said back panels of said second body and said front and said back sides of said first body.

11. The tag apparatus according to claim 9, wherein said resilient retention of said front and said back panels of said second transparent body against said ridges of said first body serves as a watertight seal preventing the inflow of outside water or moisture into the spaces, defined by said ridges of said first body, between said front and said back panels and said front and said back sides of said first body.

12. The tag apparatus according to claim 9, wherein the number of said horizontally disposed raised ridges is between 3 and 7.

13. The tag apparatus according to claim 12, wherein the number of said horizontally disposed raised ridges is 5.

14. The tag apparatus according to claim 7, wherein a label or sticker containing readable marking of indicia or printed instructions is secured within each generally rectangular-shaped space.

15. The tag apparatus according to claim 14, wherein said tag apparatus is used in conjunction with a golf bag.

16. The tag apparatus according to claim 1, wherein said contraction lips of said T-shaped head of said first body grip said front and back panels along their first end edges.

17. A tag apparatus for attachment to a bag, comprising:

(1) a first flag generally rectangular-shaped body formed of a rigid plastic material having a front side and a back side, first and second longitudinal edges, and a first end edge and a second end edge, said first flat body further having:

(a) a continuous raised ridge along its perimeter on both said front and back sides of said first flat body and extending along said first and second longitudinal edges and along said second end edge, said raised ridge being contiguous with said first and said second sides, said first flat body further having a T-shaped head positioned along its first end edge, said T-shaped head having a contraction lip disposed along each said front side and said back side;

(b) a plurality of horizontally disposed raised ridges extending from said first longitudinal edge to said second longitudinal edge on both said front and said back sides of said first flat body, said first flat body, said raised ridges being contiguous with said front and said back sides of said first flat body, wherein said plurality of horizontally disposed raised edges are positioned in an approximately parallel fashion with respect to one another in a spaced sequential fashion beginning from said second end edge and continuing toward said first end edge; and (c) wherein said first flat body has an aperture near said second end edge and positioned approximately equi-distant from said first and second longitudinal edges, said aperture being surrounded by a continuous raised ridge on both said front side and said back side of said body;

(2) a second generally flat rectangular-shaped transparent body comprising front and back panels, first and second longitudinal edges, and a closed and a first and second open end edge, wherein said front and back panels are integrally joined at said closed end thereby forming said closed end, and said front and back panels are not connected along said first and second longitudinal edges nor at said first and second open end edges, thereby forming an open end, said front and back panels thus forming a U-shaped envelope having width dimensions only slightly more than the width dimensions of said first flat body, said front and back panels further being resiliently displaceable from one another to permit insertion of said first flat body into said second flat body such that when said first flat body is inserted into said second flat body through said open end of said front and back panels, said front and back panels are forced apart and their tendency to return to the more relaxed configuration resiliently retains said first flat body within said second flat, and said contraction lips of said first flat body gripping said front and back panels along their first end edges; said first flat body thereby being positioned in a firm relation with the interior surfaces of said front and back panels, said ridges on said front and back sides of said first flat body being in frictional contact with said front and back panels of said second flat transparent body and said first flat body thereby being resiliently and removeably retained in position in said said second flat body with said ridges acting to prevent contact of said front and back panels with said front and back sides of said first flat body; said front and back panels of said secont flat transparent body each also having an aperture near said closed end and positioned approximately equi-distant from said first and second longitudinal edges of said front and said back panels, said apertures of said front and said back panels register with said aperture of said first flat body to allow an elongated strap or cord to be passed through said flat transparent second body and through said flat first body, said elongated strap or cord having means for removably attaching said tag apparatus to a bag.

18. The tag apparatus according to claim 17, wherein said resilient retention by said front and said back panels of said second flat transparent body against said ridges of said first flat body serves as an airtight seal preventing the inflow of outside air or dust into the spaces, defined by said ridges of said first body, between said front and said back panels of said second transparent body and said front and said back sides of said first flat body.

19. The tag apparatus according to claim 17 wherein said resilient retention of said front and said back panels of said second flat transparent body against said ridges of said first flat body serves as a watertight seal preventing the inflow of outside water or moisture into the spaces, defined by said ridges of said first body, between said front and said back panels and said front and said back sides of said first flat body.

20. The tag apparatus according to claim 17, wherein the number of said horizontally disposed raised ridges is between 3 and 7.

21. The tag apparatus according to claim 20, wherein the number of said horizontally disposed raised ridges is 5.

22. The tag apparatus according to claim 17, wherein a label or sticker containing readable marking of indicia or printed instructions is secured within each generally rectangular-shaped space defined by said horizontally disposed raised ridges on said first flat body and by said raised ridge along said perimeter of said first flat body.

23. The tag apparatus according to claim 17, wherein said tag apparatus is used in conjunction with a golf bag.

* * * * *